US006178931B1

(12) United States Patent
Dürr

(10) Patent No.: US 6,178,931 B1
(45) Date of Patent: Jan. 30, 2001

(54) HUB OF A FAN WHEEL FOR AN INTERNAL COMBUSTION ENGINE

(75) Inventor: Bernhard Dürr, Stuttgart (DE)

(73) Assignee: Andreas Stihl AG & Co., Waiblingen (DE)

( * ) Notice: Under 35 U.S.C. 154(b), the term of this patent shall be extended for 0 days.

(21) Appl. No.: 09/311,166

(22) Filed: May 13, 1999

(30) Foreign Application Priority Data

May 14, 1998 (DE) ..... 298 08 734

(51) Int. Cl.[7] ..... F01P 5/04; F02N 3/02

(52) U.S. Cl. ..... 123/41.65; 123/185.3; 416/60

(58) Field of Search ..... 123/41.63, 41.65, 123/185.1, 185.3; 74/7 C; 192/42; 416/60

(56) References Cited

U.S. PATENT DOCUMENTS

| | | | | |
|---|---|---|---|---|
| 2,438,669 | * | 3/1948 | Krenzke | 123/41.65 |
| 3,952,712 | * | 4/1976 | Hermanson | 123/41.65 |
| 5,287,832 | * | 2/1994 | Uhl | 123/185.3 |

* cited by examiner

*Primary Examiner*—Andrew M. Dolinar
(74) *Attorney, Agent, or Firm*—Walter Ottesen

(57) ABSTRACT

The invention is directed to a hub unit of a fan wheel for an internal combustion engine having a crankshaft and a starter device. The hub unit has a wheel body made of plastic and a hub sleeve made of a high tensile strength material. The hub sleeve carries the wheel body and is held on the crankshaft to prevent rotation relative thereto and a clamping element axially fixes the hub sleeve on the crankshaft. A starter ring is concentric with the axis and is adapted for a clutch engagement with the starter device so as to be entrainable thereby. The starter ring and the hub sleeve are originally formed as a single piece to define a hub housing.

19 Claims, 5 Drawing Sheets

HUB OF A FAN WHEEL FOR AN INTERNAL COMBUSTION ENGINE

FIELD OF THE INVENTION

The invention relates to a hub of a plastic fan wheel for an internal combustion engine. The fan wheel moves a flow of cooling air to the engine. A hub sleeve of the hub is made of a material having a high tensile strength and is especially of metal and carries a wheel body made of plastic. The hub sleeve is fixedly mounted on the crankshaft of the engine to rotate therewith and is axially fixed with a clamping element. The fixed connection of the hub sleeve to the crankshaft can be additionally secured by a form-tight connecting element in the form of an entraining element such as a key or the like.

BACKGROUND OF THE INVENTION

Known hubs for plastic fan wheels are assembled of several parts. In the conventional arrangement, the hub sleeve is a turned part having a periphery onto which a disc is pressed and attached. The plastic fan body is injection molded on this piece. The disc is soldered to the periphery of the steel hub sleeve and engages into the plastic wheel body on the fan wheel so that the torque transmission between the hub sleeve and the wheel body is ensured.

A starter ring is attached concentrically to the hub axis at the end face of the hub. The starter ring can be entrained by a starter device of the engine which can be coupled thereto. The starter device can, for example, be a pull-rope starter having a starter rope. When the starter rope is pulled, entraining elements are brought into meshing engagement with the teeth of the starter ring. When pulling the starter rope, a torque is generated and transmitted from the starter ring via the plastic of the wheel body and the hub sleeve to the crankshaft thereby bringing the engine into operation.

The manufacturing costs of such a hub are very high because, in addition to the material costs of the individual hub components, the manipulative operations when positioning and assembling the hub components are very time intensive when done with the required care.

SUMMARY OF THE INVENTION

It is an object of the invention to provide a hub of a fan wheel for an internal combustion engine which is cost effective to manufacture.

The invention is a hub unit of a fan wheel for an internal combustion engine having a crankshaft and a starter device. The hub unit includes: a wheel body made of plastic; a hub sleeve defining an axis and being made of a high tensile strength material and carrying the wheel body; means for holding the hub sleeve on the crankshaft so as to prevent rotation relative thereto; a clamping element for axially fixing the hub sleeve on the crankshaft; a starter ring concentric with the axis and adapted for a clutch engagement with the starter device so as to be entrainable thereby; and, the starter ring and the hub sleeve being originally formed as a single piece to define a hub housing.

The hub sleeve and the starter ring are configured in a formed hub housing as one piece. The hub housing can be cast. The individual elements of this housing and especially the hub sleeve and the starter ring are arranged relative to each other in the same position for each cast component. Even for a large number of hubs, components are manufactured by casting which all have the same form which can be easily provided with the plastic wheel body. Furthermore, with the one-piece configuration of the hub housing, the torques, which act on the starter ring during actuation of the starter device, are transmitted directly via the metal base body of the hub housing to the crankshaft. No stresses occur in the plastic material. The hub housing is preferably made of aluminum and is manufactured in accordance with a diecasting method.

Radially aligned anchors are preferably formed on the periphery of the hub housing. The anchors project beyond the starter ring in the radial direction and grip into the plastic wheel body in the fan wheel. The torque transmission between the hub and the fan wheel body takes place via the anchors. A gap or a space remains between the anchors and this space is filled with the plastic material of the wheel body. In this way, the form-tight connection between the aluminum hub and the plastic wheel body is improved.

The anchors are advantageously mounted so as to be rotationally symmetrical on the hub housing. The number of the anchors can be equal to the number of the entraining teeth at the inner side of the starter ring so that each entraining tooth is assigned to an anchor. The anchors grab advantageously on the hub sleeve so that the anchors are connected to the crankshaft and directly transfer torque thereto. The anchors are advantageously configured so as to be flat and lie in a plane perpendicular to the hub axis. The starter ring can be spaced axially from the hub sleeve so that the starter ring lies closely to the inner wall of the engine housing when the fan wheel is in the assembled condition. In this way, the starter ring can be driven in a simple manner by the starter pull-rope which is actuated from outside the housing. The starter ring is carried by a support shell which ensures the axial spacing of the starter ring from the hub sleeve. The starter ring can partially overlap the end section of the hub sleeve.

In an advantageous embodiment of the hub housing, the support shell of the starter ring rises axially from a disc which is formed by the mutually adjacent anchors.

The hub can be configured to have a conical shape and be mounted in the manner of a conical connection to the crankshaft. The end of the crankshaft is configured to have a corresponding conical shape. The conical hub is pretensioned with a tightening nut whereby the hub housing is fixed axially on the end of the crankshaft. In the hub, a slot can be formed in which an element can be placed which is fixed against rotation. This element engages in a corresponding slot in the crankshaft. Here, it is especially advantageous when a wedge-shaped raised portion is formed in the hub and this wedge can be brought into engagement with the slot in the crankshaft. The wedge is formed with the hub housing so that an especially simple assembly of the fan wheel is ensured.

BRIEF DESCRIPTION OF THE DRAWINGS

The invention will now be described with reference to the drawings whrein.

DESCRIPTION OF THE PREFERRED EMBODIMENTS OF THE INVENTION

Figure 6:
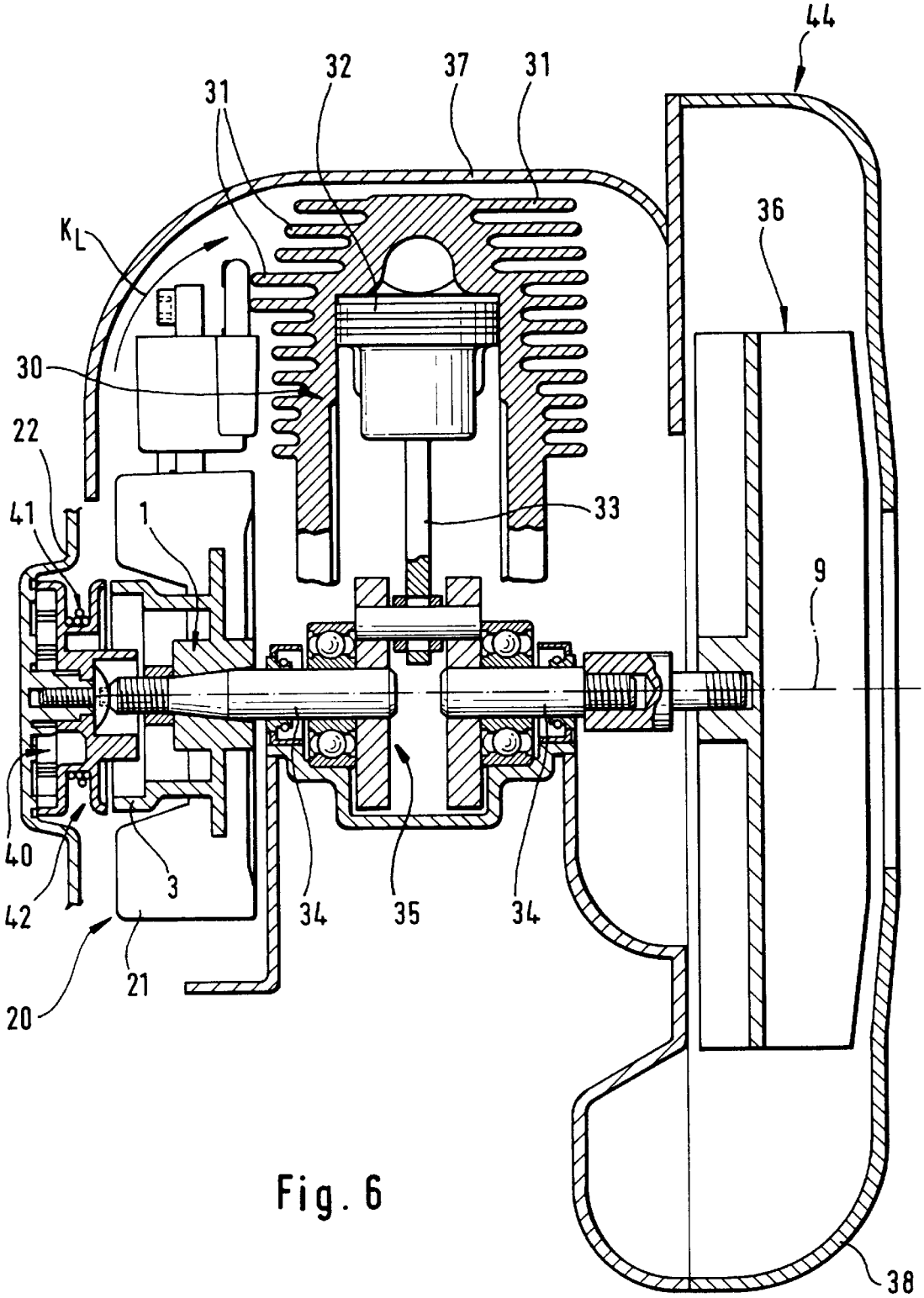

FIG. 6 shows a portable handheld work apparatus having a work tool 44 driven by an internal combustion engine 30. In the embodiment shown, the work tool is a blower wheel 36 which rotates in a blower housing 38 and discharges a blast airflow which is directed toward a surface to be blown therewith for a particular purpose. The portable handheld work apparatus can, however, also be a motor-driven chain saw, a cutoff machine, a brushcutter or the like having a work tool driven by the engine 30.

In the engine 30, a piston 32 is mounted for longitudinal movement. With the reciprocating motion, a crankshaft 34 is rotatably driven in a crank drive via a connecting rod 33 and a crank 35. The crankshaft 34 extends from the crankcase on both ends of the engine 30. The work tool (blower 36) is held on the output end so as to rotate with the crankshaft. The engine 30 is mounted within an engine housing 37 which also accommodates the crankshaft 34.

On the end of the engine 30, which lies opposite the work tool 44, a fan wheel 20 is fixedly mounted on the crankshaft 34 so as to rotate therewith. The blading of the fan wheel 20 moves a cooling air flow KL which is directed through the engine housing 37 to the cooling ribs 31 of the engine 30. The fan wheel 20 comprises essentially plastic which, as a material, has a favorable mass/volume ratio, whereby the fan wheel is light and has an effective fan blade configuration. The hub sleeve is pushed onto the end of the crankshaft and defines the hub 1 of the fan wheel. However, the hub sleeve is made of a material having a high tensile strength, especially metal. In the embodiment shown, the hub is made of aluminum. The hub sleeve has a periphery where it supports the wheel body 21 on its periphery and the wheel body is made of plastic and includes the blade configuration.

The fan wheel 20 is axially fixed on the end of the crankshaft 34 by a threaded fastener connection. In the embodiment shown, the shaft/hub connection of the fan wheel 20 is configured as a conical connection. The end of the crankshaft is provided with a thread on which a clamping screw is threadably engaged. The clamping screw lies against the hub sleeve and fixes the conical connection with a corresponding pretensioned force.

A starter device 40 of the engine 30 is mounted rearward of the free end of the crankshaft 34 in the direction of the hub axis 9. The starter device 40 is a pull-rope starter having a rope drum 42 rotatably held coaxially to the hub axis 9 of the fan wheel 20 on a fan cover 22. The fan cover 22 closes the engine housing 37 and has openings through which the cooling air KL can be inducted by the fan wheel 20. A bearing bolt is formed on the inner side of the fan cover 22 and the rope drum 42 is rotatably journalled thereon. The pull rope 41 is brought out of the engine housing 37 and has a handle (not shown) at its end. Rotational movement is imparted to the rope drum by pulling the pull rope 41. The rotation of the rope drum 42 takes place against the return force of a spring which rewinds the pull rope 41 after the actuation of the starter device 40. The starter device 40 further includes a one-way clutch which transmits the starting torque of the rope drum, which is set into motion, to the crankshaft 34 when the pull rope is pulled thereby starting the engine. A starter ring 3 is formed on the hub sleeve concentrically to the hub axis 9 and is entrained in a form-tight manner when the starter device 40 is clutch connected. Clutch teeth 14 (see FIGS. 1 to 5) are formed on the inner side of the starter ring 3 for this purpose. Entraining pawls or the like of the pull-rope starter 40 are brought into engagement with these teeth.

Figure 1:
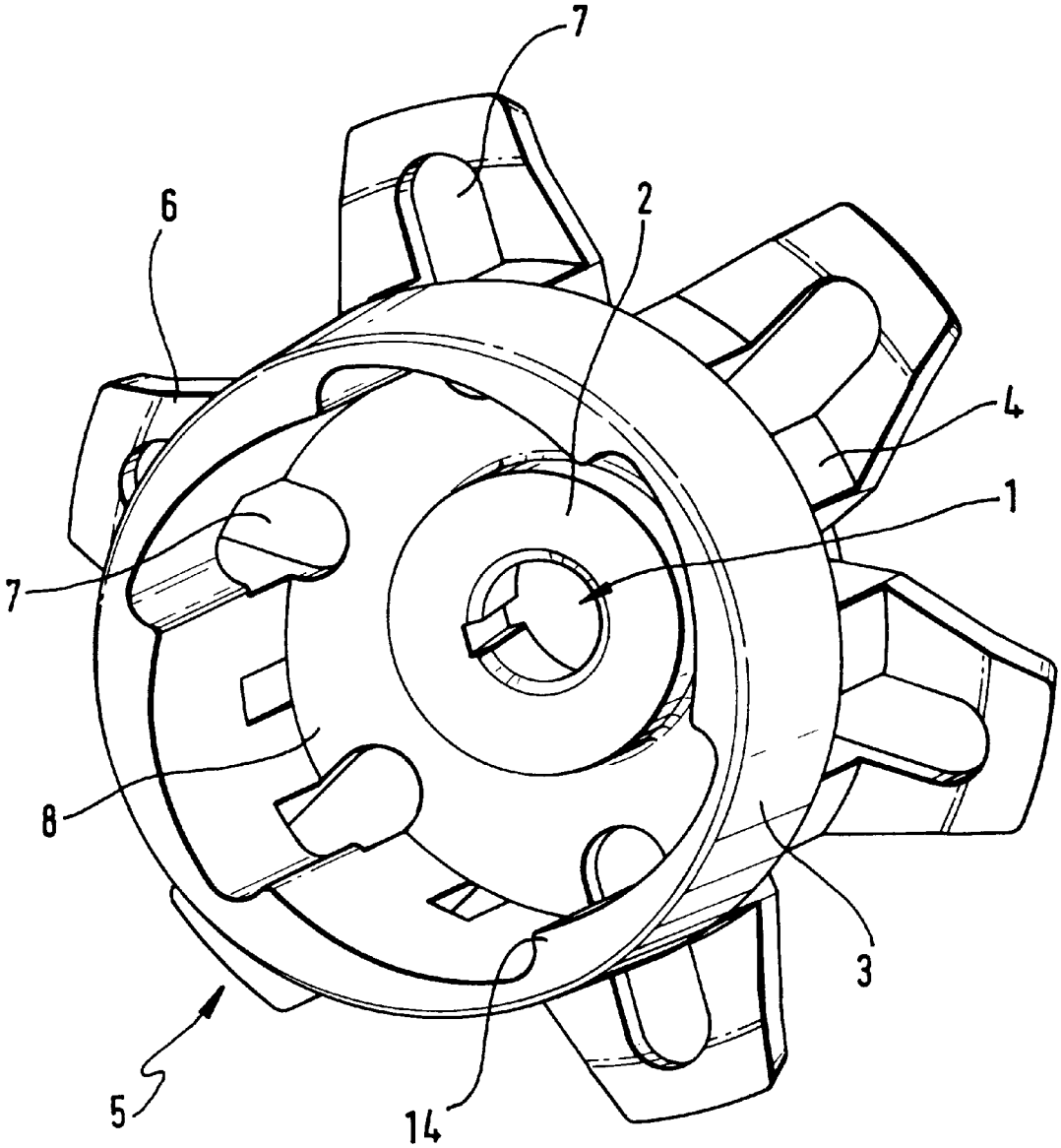
FIG. 1 is a perspective view of the hub according to the invention.

According to the invention, the hub sleeve and the starter ring 3 are formed in a one-piece hub housing for the hub 1 of the fan wheel 20. FIG. 1 shows a view of the hub housing 5 of the fan wheel which, for reasons of clarity, is shown without the wheel body made of plastic. The wheel body can be injection molded onto the hub housing 5.

The starter ring 3 lies axially in spaced relation to the hub sleeve 2 whereby, on the one hand, a wider configuration of the air-moving plastic wheel body is made possible and, on the other hand, and when the fan wheel is assembled, an intermediate space is defined between the fan wheel cover and the end face of the fan wheel through which sufficient cooling air is moved.

The starter ring 3 of the hub 1 is carried by a support shell 4. The starter ring 3 has a greater diameter than the hub sleeve 2. The diameter of the starter ring 3 is matched to the geometry and the dimensions of the pull-rope starter and its clutch (not shown). The wall surface of the starter ring 3 covers the end section of the hub sleeve 2 in the axial direction.

Radially directed anchors 6 are formed on the periphery of the hub housing 5. These anchors engage in the plastic wheel body of the fan wheel and ensure the form-tight transmission of force in the wheel body. The anchors 6 are disc-shaped and extend in the peripheral direction of the hub 1. The anchors each lie at the same axial elevation of the hub 1 in a plane perpendicular to the hub axis 9 and conjointly define a common anchor disc 8 surrounding the hub sleeve 2. The support shell 4 of the starter ring 3 rises from the disc 8 defining the anchors 6 whereby a space is formed for accommodating the starter clutch and the clamping bolt to fix the hub on the crankshaft. This space is delimited by the hub housing 5 by the starter ring 3, the support shell 4 and the disc 8.

The anchors 6 of the one-piece hub housing 5 project radially beyond the starter ring and engage deeply into the plastic wheel body. The anchors 6 are arranged rotationally symmetrical on the periphery of the hub 1 so that the hub housing 5 can rotate without imbalance. In the embodiment shown the hub housing 5 has six anchors 6. The number of anchors 6 is here equal to the number of the clutch teeth 14 which are formed on the inner wall of the starter ring 3. The anchors 6 lie at approximately the same rotational angular position as the clutch teeth 14.

The anchors 6 are provided with breakthroughs 7 which are penetrated when injection molding the wheel body of plastic and improve the form-tight connection between the hub and the wheel body. The breakthroughs 7 extend from a region close to the free ends of the anchors 6 in the radial direction and into the region of the anchor disc 8 covered by the starter ring 3.

In the support shell 4, breakthroughs 17 are likewise cut out which extend axially and, referred to the rotational angular position, overlap the radial breakthroughs 7 in the anchors. The injection molded plastic material thereby penetrates into the space, which is defined within the support shell 4 of the starter ring 3, and extends to the periphery of the hub sleeve 2. The end face of the hub sleeve 2 extends in the axial direction of the hub 1 toward the starter ring 3 farther than the axial extension of the breakthroughs 17 in the support shell 4 so that the hub sleeve 2 extends above the surface of the injection-molded plastic material and the hub 1 is freely accessible.

The moving capacity of the fan wheel is defined by the configuration of the wheel body and also the rotational speed of the fan wheel. Different torques are generated in each application of the hub of the invention for different work apparatus and different motor capacities in dependence upon the required moving capacity of the fan wheel. These torques are transmitted by the hub housing 5. The required stiffness and therefore the reliable torque transmission in each specific application is achieved by a suitable configuration of the support shell 4 with reference to its axial length and the wall thicknesses of the individual component regions. For the one-piece hub housing 5 of the invention, the starter torque is transferred to the hub sleeve 2 and therefore directly to the crankshaft with the clutch engagement of the pull-rope starter so that, in contrast to known constructions, a force flow via the plastic of the wheel body is unnecessary.

Figure 2:
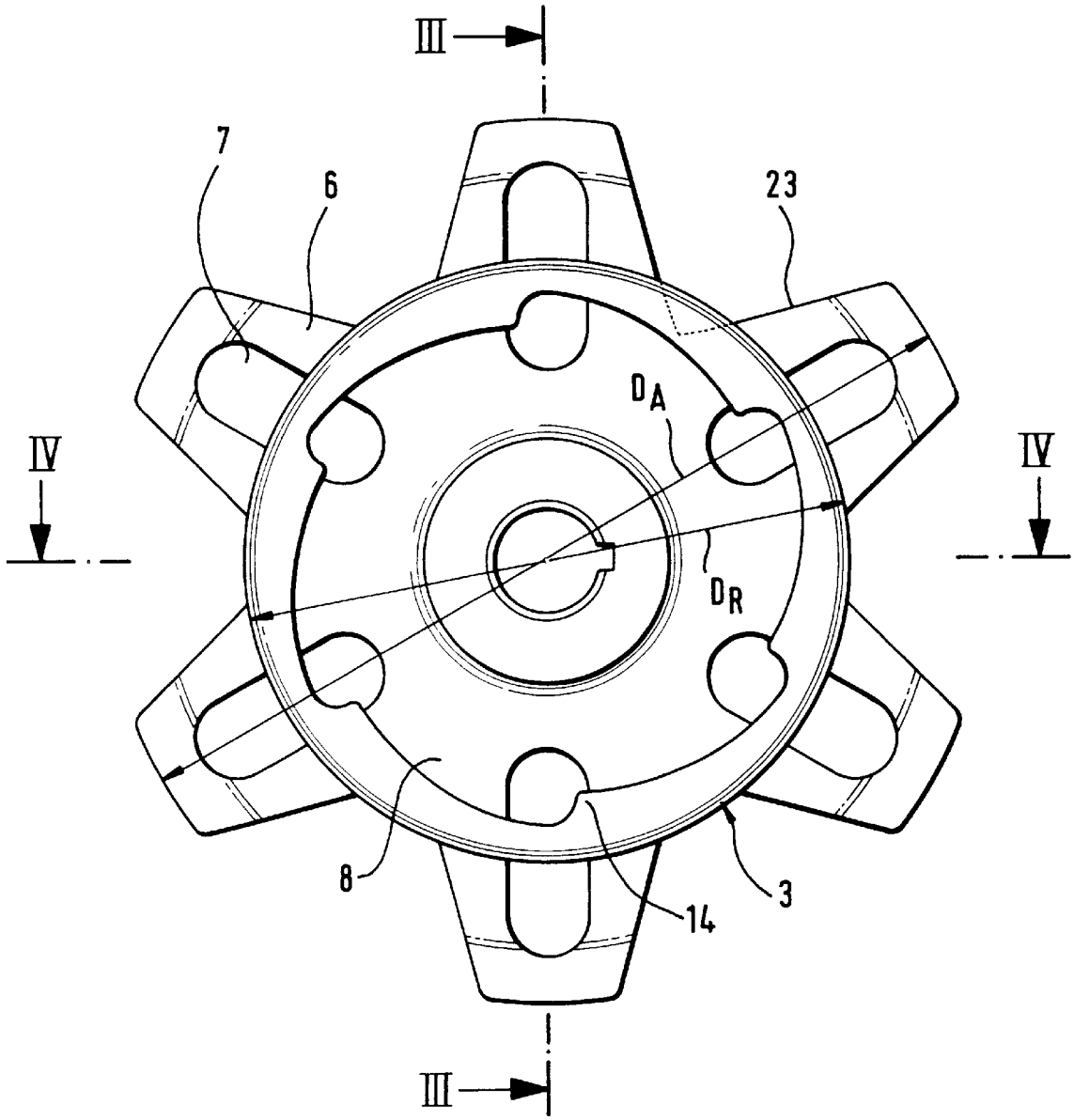
FIG. 2 is a plan view of the hub of FIG. 1.

In FIG. 2, the hub housing is shown as a plan view of the end provided with the starter ring 3. From FIG. 2, it is especially clear that the widths of the anchors 6, which are arranged rotationally symmetrical on the periphery of the hub housing, are continuously reduced toward the free ends. The width is here understood to be the extent to which the disc-shaped anchors 6 extend in the peripheral direction of the hub housing. The anchors 6 lie in a common plane and define the anchor disc 8 which axially delimits the space anchored by the starter ring 3.

The mutually adjacent side edges 23 of two anchors 6 are brought together at a lesser radius with respect to the hub axis than the radius of the starter ring so that cutouts are formed within the surface of the anchor disc 8 enclosed by the starter ring 3. In this way, plastic material of the injection molded wheel body can penetrate into the interior of the hub housing. An opening (not shown in FIG. 2) is provided in the axial support shell of the starter ring 3 and this opening is formed in overlap with this cutout. The cutouts, which are formed by the side edges of the anchor edges 23, each lie in axial overlap behind one of the clutch teeth 14 which project out from the inner wall of the starter ring 3 for a form-tight clutch engagement of the pull-rope starter. The cutouts or openings of the anchor disc 8, which are formed at the foot region of the anchors 6 by the mutually adjoining side edges 23, are shown in FIG. 2 in phantom outline.

The diameter $D_R$ of the starter ring 3 is matched to the engageable components of the pull-rope starter. The radially aligned anchors 6 project beyond the starter ring 3 in the radial direction so that they engage deeply into the plastic body of the fan wheel and provide a reliable torque transfer. The diameter $D_A$ of the circle of the free ends of the anchors 6 is approximately 1.2 to 2.5 times the diameter $D_R$ of the starter ring 3. In the embodiment shown, an especially advantageous dimensioning of the hub housing is shown having a ratio $D_A/D_R$ of 1.44.

A radial breakthrough 7 is cut out in each of the anchors 6. This breakthrough 7 extends from a region next to the free end of the anchor 6 to beyond the annular section of the anchor disc 8 covered by the starter ring 3 and into the interior space of the hub housing enclosed by the starter ring 3.

Figure 3:
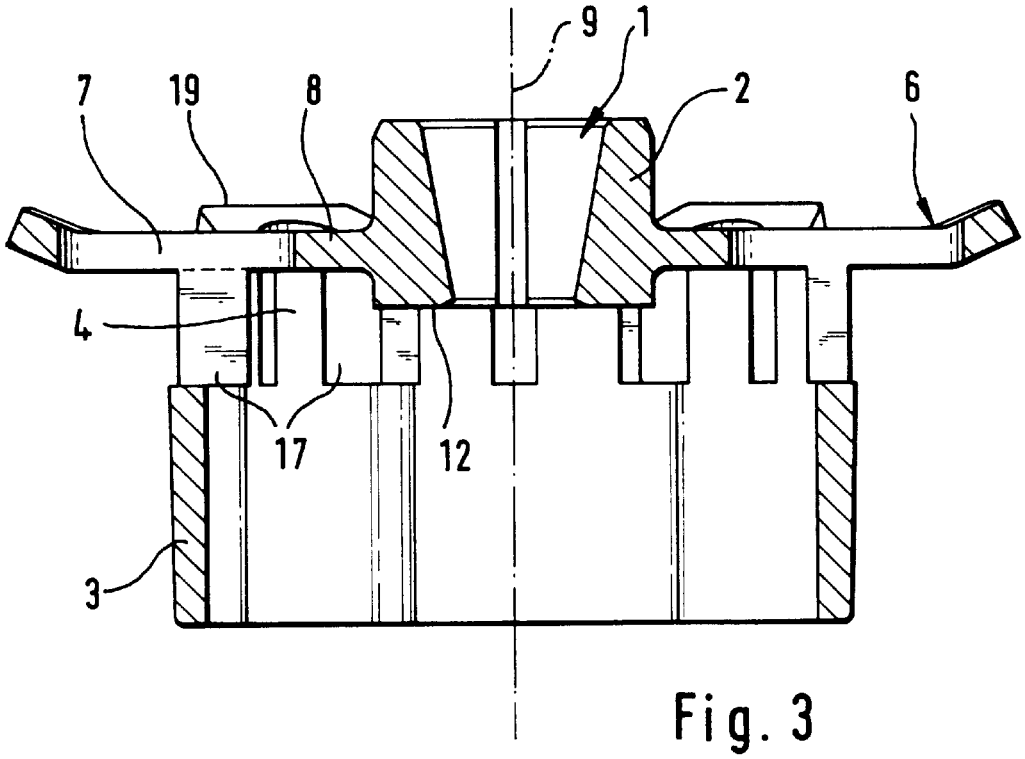
FIG. 3 is a section view of the hub taken along line III—III of FIG. 2.

FIG. 3 shows a longitudinal section view of the hub housing taken along line III—III of FIG. 2. FIG. 3 shows clearly that the radial breakthroughs 7 in the anchor disc 8 and the axial cutouts 17 in the support shell 4 of the starter ring 3 conjointly define a common opening. The support shell 4 rises axially from the anchor disc 8 with a diameter corresponding approximately to the diameter of the starter ring 3. The anchor disc 8 is defined by the anchors 6. With the one-piece configuration of the hub housing, the starter ring 3 is connected via the support shell 4 and the anchor disc 8 to the hub sleeve 2 so that the rotational torques of the pull-rope starter are transmitted from the hub 1 to the crankshaft of the engine via the high tensile strength material of the hub housing which is made completely of aluminum.

The free ends 19 of the anchors 6 are configured so that they are angled whereby the form-tight connection between the hub housing and the plastic wheel body is further improved. The angled ends 19 are thereby directed to the end face of the hub housing which lies opposite the starter ring 3. The ends 19 of the anchors can also be angled in other directions depending upon the expected load on the fan wheel and the corresponding dimensioning of the elements of the hub housing.

The cutouts 7 in the anchor disc 8 extend into the anchors 6 up to approximately the foot point whereat the free ends 19 are angled. The anchor disc 8 is formed on the periphery of the hub sleeve 9 so that the anchors 6 are supported at the hub sleeve 2. The wall thickness of the anchor disc 8 can be locally increased. By varying the disc thickness, the strength of the hub housing can be adapted to the stress to which the material is subjected. The end face of the hub sleeve 2 extends through the interior-lying end face of the anchor disc 8 into the interior of the hub housing 5 and defines a radial shoulder 12. The shoulder 12 is provided to support a clamping nut for axially fixing the hub 1 and rises above the plane of the anchor disc 8. In this way, an annular space is formed about the hub sleeve 2 which is filled with plastic material during injection molding of the wheel body.

The hub 1 is configured so as to have a conical shape and is held in the manner of a conical connection to the crankshaft of the internal combustion engine. The diameter of the hub 1 is tapered toward the starter ring 3 to have a conical shape and when the clamping connection is tightened, the hub is pressed onto the end of the crankshaft which is formed to have a correspondingly conical shape.

Figure 4:
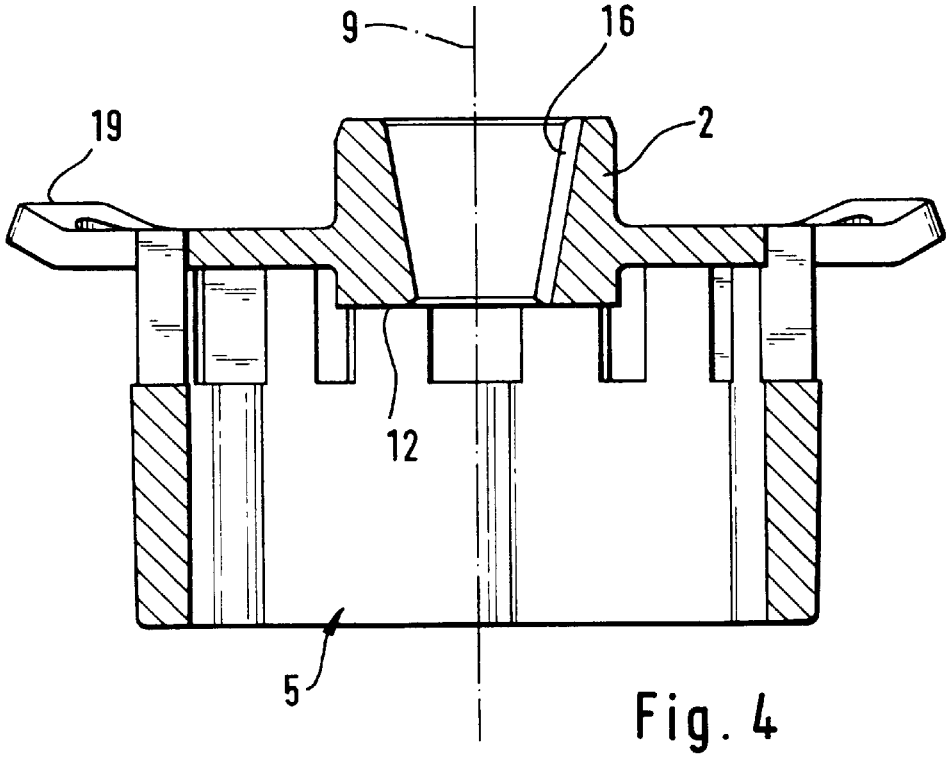
FIG. 4 is a section view of the hub taken along line IV—IV of FIG. 2.

As shown in the section view of FIG. 4, the conical hub, which is configured in the hub sleeve 2, has a slot 16 in which an element can be placed which prevents a rotation of hub sleeve 2 relative to the crankshaft. The rotation safe element can be a key and a wedge is seen to be especially advantageous. The slot 16 is configured so as to be clear through and can be cut out at the inner side of the hub sleeve 2 or it can be considered especially advantageously already in the original form of the hub housing.

Figure 5:
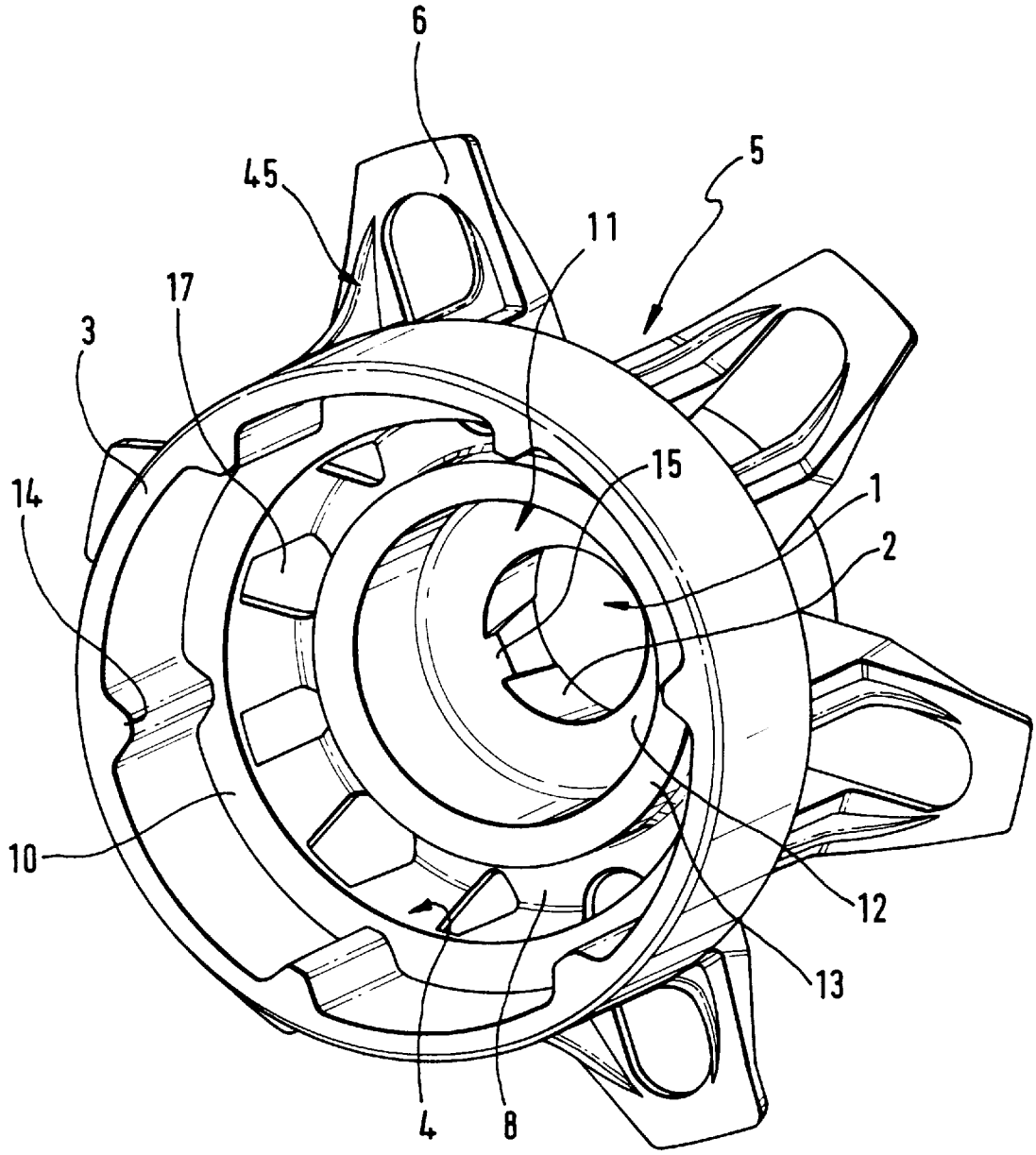
FIG. 5 is a perspective view of an alternate embodiment of the hub of the invention; and, FIG. 6 is a section view of a work apparatus having a drive unit equipped with a fan wheel having a hub according to the invention.

FIG. 5 shows an alternate embodiment of an aluminum hub of the invention. A wedge 15 is already formed in the original form of the hub housing as an element for preventing rotation. The wedge 15 engages in a corresponding slot of the crankshaft when assembled and guarantees the fixed rotation connection so that the hub cannot rotate relative to the crankshaft. The end of the hub sleeve 2, which lies within the hub housing, is expanded with respect to the diameter to a receptacle cup 11 for the free end of the crankshaft. The radial shoulder 12 forms the base of the receiving cup 11 for the contact engagement of the tightening nut which is likewise disposed within the receiving cup in the assembled condition of the fan wheel.

The receiving cup 11 has a peripherally extending wall so that the plastic material, during injection molding of the wheel body to the hub housing, does not penetrate into the receiving cup 11. During the injection molding process, the plastic material penetrates through the breakthroughs 17 of the support shell 4 as well as the cutouts in the anchor disc 8 (see FIGS. 2 to 4) into the hub housing 5. The edge 13 lifts from the surface of the plastic material of the wheel body located within the hub housing 5. Console struts 45 are arranged on both sides of the breakthroughs (7, 17) of the anchors 6 or of the support shell 4. The console struts 45 increase the stiffness of the connection of the anchor disc 8 to the hub housing 5 and improve the form-tight connection between the hub housing and the plastic wheel body.

A peripherally extending annular step 10 is formed within the hub housing 5 between the starter ring 3 and the end of the breakthrough 17 in the support cover 4. The ring step 10 lies approximately at the same elevation as the edge 13 of the receiving cup 11. During injection molding of the plastic wheel body, the annular cross section of the hub housing, which is formed between the receiving cup 11 and the annular step 10, is sealed by the contact of a corresponding core component of the casting tool. The annular step 10 extends beyond the inwardly directed clutch teeth 14 of the starter ring 3 into the interior of the hub housing 5.

It is understood that the foregoing description is that of the preferred embodiments of the invention and that various changes and modifications may be made thereto without departing from the spirit and scope of the invention as defined in the appended claims.

What is claimed is:

1. A hub unit a fan wheel for an internal combustion engine having a crankshaft and a starter device, said hub unit comprising:

a wheel body made of plastic;

a hub sleeve defining an axis and being made of a high tensile strength material and carrying said wheel body;

means for holding said hub sleeve on said crankshaft so as to prevent rotation relative thereto;

a clamping element for axially fixing said hub sleeve on said crankshaft;

a starter ring concentric with said axis and adapted for a clutch engagement with said starter device so as to be entrainable thereby;

said starter ring and said hub sleeve being originally formed as a single piece to define a hub housing;

said hub housing including a support shell for carrying said starter ring in axial spaced relationship to said hub sleeve;

said hub housing has a periphery; and, wherein said hub unit further comprises a plurality of radially directed anchors formed on said periphery; and, said anchors extending radially beyond said starter ring and being disposed rotationally symmetric along said periphery.

2. The hub unit of claim 1, wherein said starter ring has a diameter ($D_R$) significantly greater than the diameter of said hub sleeve.

3. The hub unit of claim 1, wherein said starter ring has a diameter ($D_R$) and said diameter ($D_R$) is a first diameter ($D_R$); and, said anchors have respective free ends defining a locus of points through which an imaginary circle can be drawn having a diameter ($D_A$) greater than said first diameter ($D_R$) by a factor of approximately 1.2 to 1.5.

4. The hub unit of claim 3, wherein said anchors are configured to be flat and conjointly define a plane perpendicular to said axis; and, each of said anchors has a width which becomes continuously shorter toward the free end thereof.

5. The hub unit of claim 4, further comprising an anchor disc conjointly defined by said anchors and lying in said plane; and, said support shell extending from said anchor disc in the direction of said axis.

6. The hub unit of claim 5, wherein said breakthroughs extend in the direction of said axis beyond where said support shell is joined to said disc.

7. The hub unit of claim 6, wherein said support shell has breakthroughs formed therein.

8. The hub unit of claim 7, wherein said breakthroughs formed in said anchors are first breakthroughs disposed at respective angles of rotation of said hub housing; said breakthroughs in said support shell are second breakthroughs corresponding to respective ones of said first breakthroughs and located at corresponding ones of said angles of rotation; and, each one of said first breakthroughs and a corresponding one of said second breakthroughs conjointly defining a common breakthrough in said hub housing.

9. The hub unit of claim 8, wherein each one of said anchors has two web supports for joining said one anchor to said support shell; and, said web supports being on respective sides of said common breakthrough.

10. The hub unit of claim 9, wherein said hub sleeve has an end wall forming part of said hub housing; said end wall rising above said plane to define a receiving cup for accommodating a free end of said crankshaft therein while defining a shoulder for receiving said clamping element thereagainst for clamping said hub housing to said crankshaft; said end wall having a through opening formed therein for receiving the free end of said crankshaft therethrough; said receiving cup having a peripheral wall extending from said shoulder; and, said peripheral wall and said shoulder conjointly delimiting said receiving cup.

11. The hub unit of claim 10, said hub housing having an annular step formed in the inner wall of said support shell at an elevation corresponding to the respective ends of said second breakthroughs; said receiving cup having an edge along said peripheral wall in spaced relationship to said shoulder; and, said annular step being approximately at the elevation of said edge.

12. The hub unit of claim 1, wherein said anchors are joined to said hub sleeve.

13. The hub unit of claim 1, wherein each of said anchors has an end segment bent at a predetermined angle relative to the remainder thereof.

14. The hub unit of claim 1, wherein each of said anchors has a breakthrough formed therein.

15. The hub unit of claim 1, said support shell and said starter ring having the same outer diameter.

16. The hub unit of claim 1, wherein said crankshaft has a conically shaped free end; said hub housing has an end wall formed therein; said end wall has a conically shaped opening formed therein for receiving said conically shaped free end of said crankshaft therein to define a conical joint therewith; and, said end wall having a slot formed therein at said opening for accommodating an entraining element therein to prevent said hub housing from rotating relative to said crankshaft.

17. The hub unit of claim 1, said hub housing having an end wall defining a through opening therethrough for accommodating a free end of said crankshaft; said free end having a slot formed therein; and, a wedge formed on said end wall for engaging in said slot to prevent rotation of said hub housing relative to said crankshaft.

18. The hub unit of claim 1, wherein said hub housing is made of aluminum.

19. The hub unit of claim 1, wherein said hub housing is made of metal.

* * * * *

UNITED STATES PATENT AND TRADEMARK OFFICE

CERTIFICATE OF CORRECTION

PATENT NO. : 6,178,931 B1
DATED : January 30, 2001
INVENTOR(S) : Bernhard Durr

It is certified that error appears in the above-identified patent and that said Letters Patent is hereby corrected as shown below:

Column 2,
Line 54, delete "whrein" and substitute -- wherein -- therefor.

Column 3,
Line 23 delete "KL" and substitute -- $K_L$ -- therefor.
Line 49, delete "KL" and substitute -- $K_L$ -- therefor.

Column 4,
Line 41, between "shown" and "the", insert a comma.

Column 7,
Line 23, between "unit" and "a", insert -- of --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*